US010526053B2

(12) United States Patent
Inzadi

(10) Patent No.: US 10,526,053 B2
(45) Date of Patent: Jan. 7, 2020

(54) PLEASURE BOAT PROVIDED WITH A SYSTEM FOR LAUNCHING/HAULING A WATER CRAFT

(71) Applicant: SANLORENZO S.P.A., Ameglia (IT)

(72) Inventor: Roberto Inzadi, Ameglia (IT)

(73) Assignee: SANLORENZO S.P.A., Ameglia (SP) (IT)

( * ) Notice: Subject to any disclaimer, the term of this patent is extended or adjusted under 35 U.S.C. 154(b) by 0 days.

(21) Appl. No.: 16/323,138

(22) PCT Filed: Jun. 27, 2017

(86) PCT No.: PCT/IB2017/053841
§ 371 (c)(1),
(2) Date: Feb. 4, 2019

(87) PCT Pub. No.: WO2018/025101
PCT Pub. Date: Feb. 8, 2018

(65) Prior Publication Data

US 2019/0161147 A1 May 30, 2019

(30) Foreign Application Priority Data

Aug. 5, 2016 (IT) ..... 102016000082867

(51) Int. Cl.
*B63B 27/36* (2006.01)
*B63B 27/16* (2006.01)
(Continued)

(52) U.S. Cl.
CPC ..... *B63B 27/36* (2013.01); *B63B 27/16* (2013.01); *B63B 35/40* (2013.01); *B66C 13/02* (2013.01); *B63B 23/32* (2013.01)

(58) Field of Classification Search
CPC ..... B63B 23/00; B63B 23/02; B63B 23/32; B63B 23/40; B63B 27/00; B63B 27/143;
(Continued)

(56) References Cited

U.S. PATENT DOCUMENTS 6,003,463 A * 12/1999 Giesler ..... B63B 23/32 114/259
7,866,275 B2 1/2011 Schmidt, Jr.
(Continued)

FOREIGN PATENT DOCUMENTS

DE 195 00 182 A1 7/1996
DE 20 2010 004 388 U1 8/2010
(Continued)

*Primary Examiner* — Lars A Olson
(74) *Attorney, Agent, or Firm* — Howson & Howson LLP

(57) ABSTRACT

A pleasure boat with a system for launching/hauling a water craft is provided. The system includes a platform movable from a first position, in which it is substantially flush with the floor of the parking area of the boat, to a second position, in which it is below the water surface. The system also includes a cradle for the water craft, a guiding system for the cradle which comprises first guides extending in the parking area and second guides extending on the platform, and a handling system. The handling system includes a first handling assembly, arranged in the parking area to move the cradle along the first guides, and a second handling assembly, arranged in the platform to move the cradle along the second guides. The system allows the water craft to be automatically transferred from the parking area to the platform, and vice versa, with no manual intervention.

18 Claims, 11 Drawing Sheets

(51) Int. Cl.
*B63B 35/40* (2006.01)
*B66C 13/02* (2006.01)
*B63B 23/32* (2006.01)

(58) Field of Classification Search
CPC ..... B63B 27/146; B63B 27/16; B63B 27/36; B63B 35/40; B66C 13/00; B66C 13/02
USPC ..... 114/259, 369
See application file for complete search history.

(56) References Cited

U.S. PATENT DOCUMENTS

| | | | | |
|---|---|---|---|---|
| 8,061,932 | B1 * | 11/2011 | Latham | B63B 27/36<br>114/259 |
| 8,539,896 | B2 * | 9/2013 | Bolline | B63B 27/143<br>114/259 |
| 2013/0340668 | A1 * | 12/2013 | Robertson | B63B 27/146<br>114/381 |
| 2014/0060414 | A1 * | 3/2014 | Buck | B63B 27/143<br>114/259 |

FOREIGN PATENT DOCUMENTS

| | | | |
|---|---|---|---|
| DE | 20 2011 001 460 | U1 | 5/2011 |
| EP | 2275339 | A1 | 1/2011 |

* cited by examiner

PLEASURE BOAT PROVIDED WITH A SYSTEM FOR LAUNCHING/HAULING A WATER CRAFT

TECHNICAL FIELD OF THE INVENTION

The present invention relates to a pleasure boat provided with a system for launching and hauling a water craft.

More particularly, the present invention relates to a pleasure boat, such as a luxury boat, a yacht or the like, which is provided with a system for launching and hauling a water craft which is sized so as to be accommodated in a garage room or in a parking area provided in the stern portion of said boat, such as a tender or a jet ski.

BACKGROUND OF THE INVENTION

Pleasure boats, such as luxury boats, yachts and the like, comprising a garage room accommodating one or more small water crafts are known.

Said water crafts may be, for instance, tenders or dinghies used by the yacht passengers for short distances. Alternatively, said water crafts may have a recreational or leisure purposes; this is the case, for instance, of jet skis and the like.

When the pleasure boat is equipped with such a water craft, it is also usually provided with a system for launching (i.e. setting in water) and hauling (i.e. pulling back on board) said water craft.

In their simplest embodiment, said systems for launching/hauling the water craft comprise an inclined plane, along which the water craft can be moved by means of a chute with rollers and sliders for launching and hauling it. See for instance document DE 19500182.

However, using such inclined plane requires large spaces, which is a relevant drawback in the field of pleasure boats, in which space optimization represents one of the main requirements in the designing step.

On the other hand, systems for launching/hauling a water craft are also known which comprise a platform, on which the water craft is accommodated, and a kinematic system for moving said platform from a first position inside the garage room of the pleasure boat to a second position below the water surface, and vice versa. See for instance document U.S. 2010/0107960.

The evident need for maintaining the platform in a horizontal position (i.e. parallel to the floor of the garage room and to the water surface) all along the movement from the first to the second position (and vice versa) requires the use of very complicated kinematic systems, with all the consequent inconveniences relating to maintenance, risks of failures and malfunctions and so on.

Such inconveniences are particularly penalizing when considering that failures and malfunctions may occur in open sea or in other uncomfortable situations.

Finally, pleasure boats are known which are provided with a system for launching/hauling a water craft that comprises a shelf or platform arranged adjacent to the hull of the boat at the garage room, said platform being able to move in vertical direction between a first position in which the upper surface of the platform is substantially flush with the floor of the garage room and a second position on which said surface is below the water surface. This solution implies evident advantages: firstly, since the platform movement takes place along a vertical direction only, very simple kinematic devices can be used for moving said platform; secondly, when the platform is not used for launching or hauling the water craft, it can be maintained in the first position, flush with the floor of the garage room, and provide an additional space exploitable by the passengers of the boat.

However, the problem arises of transferring the water craft from the garage room to the platform, for subsequent launching, and—vice versa—of bringing said water craft back into the garage room after having pulled it out of the water and onto the platform.

Known systems neither disclose nor suggest any solution capable of carrying out the aforesaid operations in a completely automatic manner.

EP 2275339 discloses a pleasure boat provided with a system for launching/hauling a tender or similar water craft, which system comprises a shelf or platform arranged next to and aligned with the outer side of the boat garage room and movable between a first position in which the wall of the platform adjacent to said garage room is substantially flush with the outer side of said garage room to a second position in which said platform is below the water surface.

In order to transfer the water craft from the garage room to the platform, and vice versa, the water craft is received in a cradle provided with rolling means and the garage room and the platform are provided with respective guides along which the cradle rolling means can move and which are aligned to each other when the platform is in its first position: with the platform in said first position, the water craft can be transferred from the garage room to the platform by moving it along the guides of the garage room and then along the guides of the platform; said water craft can be brought back from the platform to the garage room by the reverse movement.

In the described system, the floor of the garage room is sufficiently inclined to allow the cradle to roll towards the platform during launching; in order to bring the water craft back into the garage room, a motorized pulley is provided, which pulls the cradle into said garage room by means of ropes or cables.

Therefore, even in the system described in EP 2275339 a manual intervention by an operator is required for engaging/releasing the ropes connected to the cradle carrying the water craft.

Moreover, in the arrangement disclosed in EP 2275339 the water craft is arranged longitudinally aligned with the boat, which requires a platform with a large size and—most importantly—a very deep garage room, which occupies useful space in the boat.

The main object of the present invention is to overcome the drawbacks of prior art, by providing a system for launching/hauling a water craft that can be actuated in a completely automatic manner, without the need for any intervention from an operator.

Another object of the present invention is to provide a system for launching/hauling a water craft that allows to optimize the use of the spaces inside the pleasure boat.

A further object of the present invention is to provide a system that allows to avoid the risk of shocks, collisions or jamming while moving the water craft.

These and other objects are achieved by the pleasure boat as claimed in the appended claims.

SUMMARY OF THE INVENTION

The pleasure boat according to the invention comprises a hull in which a waterline is defined and in which a parking area accommodating at least one water craft, such as a tender or a jet ski, is arranged.

The boat according to the invention further comprises a system for launching/hauling said water craft, comprising:

- a shelf or platform arranged side by side with the boat hull at the parking area and comprising a floor which is substantially parallel to the floor of said parking area, said platform being movable at least between a first position in which its floor is substantially flush with the floor of the parking area and a second position in which its floor is below the waterline of said hull;
- a cradle receiving the water craft;
- a system for guiding said cradle from said parking area to said platform, and vice versa, said guiding system comprising one or more guides extending along the floor of the parking area and ending at the outer side of said parking area, facing said platform, and one or more guides extending along the floor of said platform and ending at the side of said platform facing the parking area, the end portions of said first and second guides facing each other and being aligned to each other when the platform is in said first position;
- a system for moving said cradle from said parking area to said platform, and vice versa, said handling system comprising a first handling assembly, located in said parking area and arranged for moving said cradle along said first guides, and a second handling assembly, located on said platform and arranged for moving said cradle along said second guides.

Thanks to the fact that the system for launching/hauling a water craft of the boat according to the invention comprises separate, independent handling assemblies for moving the water craft along the floor of the parking area and along the floor of the platform, the water craft can be automatically transferred from said parking area to said platform, and vice versa, with no manual intervention, and such transfer can be—preferably—remotely controlled.

To this purpose, the handling system is designed so as to allow to release the cradle from the first handling assembly and engage the cradle with said second handling assembly when the water craft is launched and to allow to release the cradle from the second handling assembly and engage the cradle with said first handling assembly when the water craft is hauled.

Advantageously, in a preferred embodiment of the invention, the parking area is arranged in a stern portion of the hull and the cradle is arranged with its longitudinal axis substantially perpendicular to the boat longitudinal axis, i.e. the water craft is arranged on the cradle in a position perpendicular to the boat.

Such arrangement allows to use a platform with limited size and—most importantly—to minimize the space occupied by the parking area.

In a preferred embodiment of the invention, the first and second guides are recessed with respect to the parking area floor and to the platform floor and the first and second handling assemblies are arranged below the plane of the parking area floor and of the platform floor.

In this way, the parking area floor and the platform floor are substantially flat, with no asperity or obstacle that could cause accidents to the boat passengers.

Advantageously, in a preferred embodiment of the invention, the cradle is bound to the first and second guides so that it can slide—preferably with reduced friction—along them without being able to move relative to them in a vertical direction.

In a preferred embodiment of the invention, the cradle is provided with one or more rollers having a rotation axis which is substantially perpendicular to the longitudinal axis of the cradle: said rollers allow to easily move the water craft along the cradle and to easily place it in the correct position, so as to avoid the risk of jamming or shocks.

BRIEF DESCRIPTION OF THE DRAWINGS

Further features and advantages of the invention will become more evident from the following detailed description of a preferred embodiment of a pleasure boat according to the invention, given by way of non-limiting example with reference to the attached drawings, in which.

DETAILED DESCRIPTION OF A PREFERRED EMBODIMENT OF THE INVENTION

Figure 1:
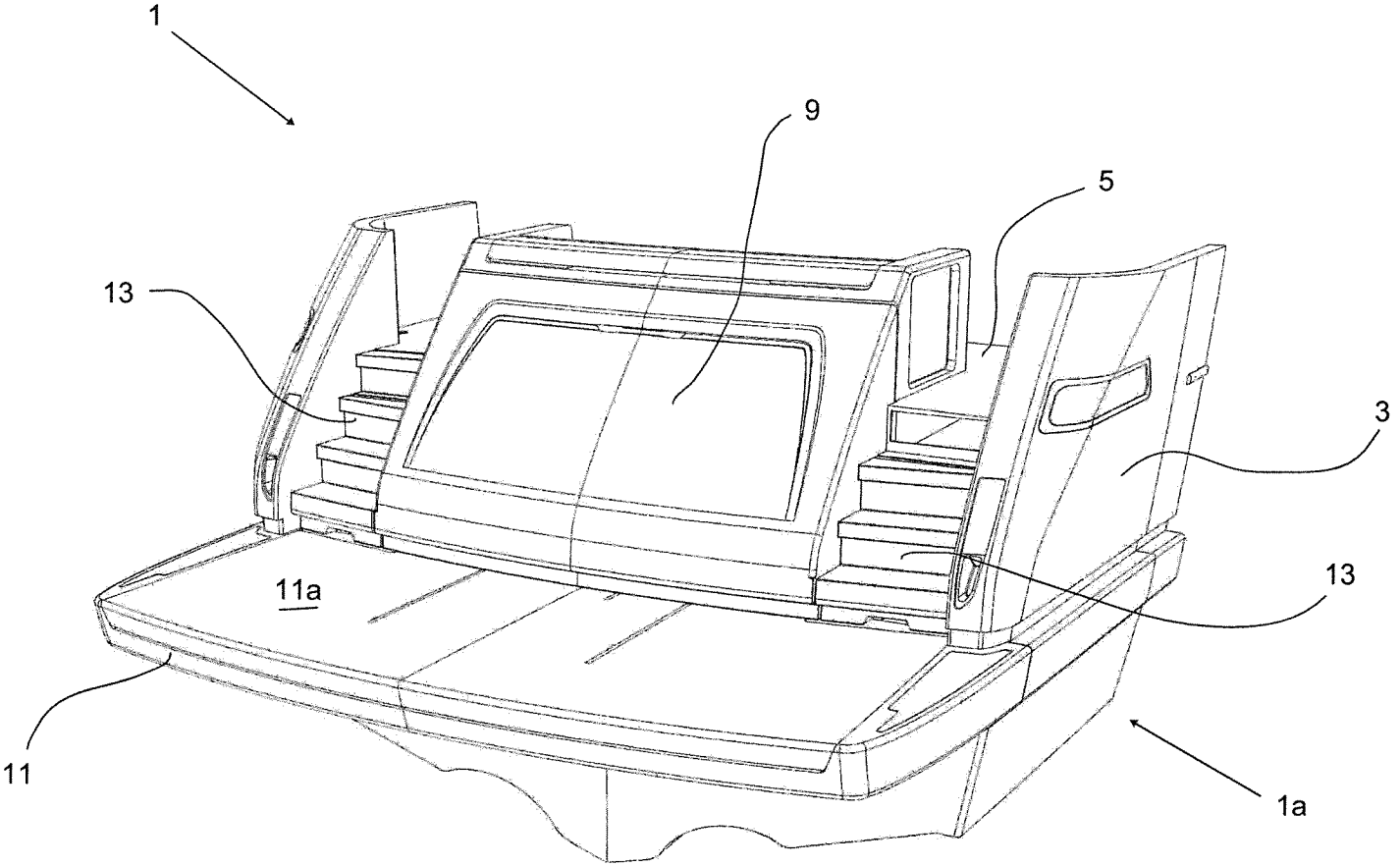
FIG. 1 schematically shows a portion of a pleasure boat according to the invention, comprising a garage room, which is shown in a closed configuration.
Figure 2:
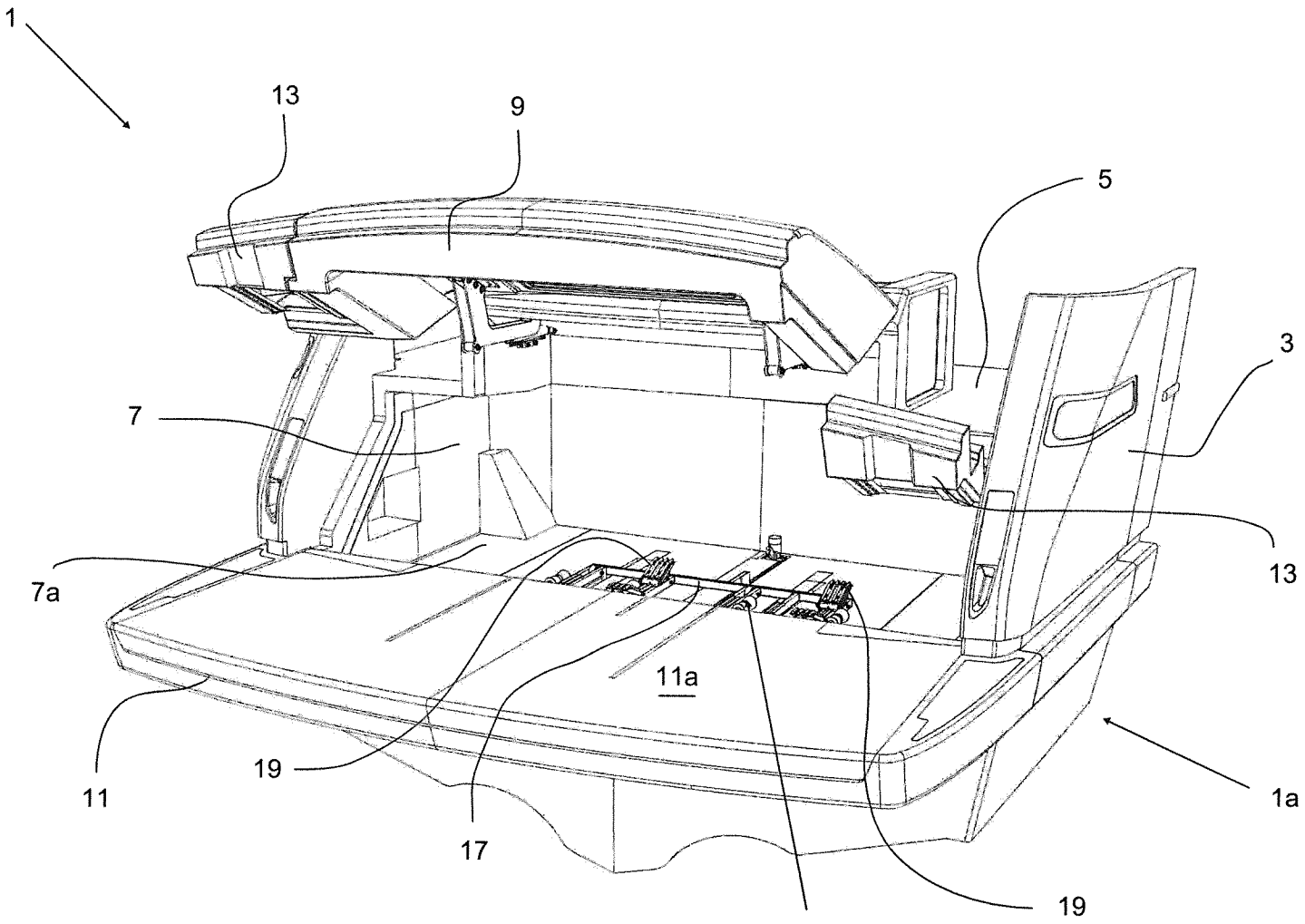
FIG. 2 schematically shows the boat portion of FIG. 1, with the garage room shown in an open configuration.
Figure 3:
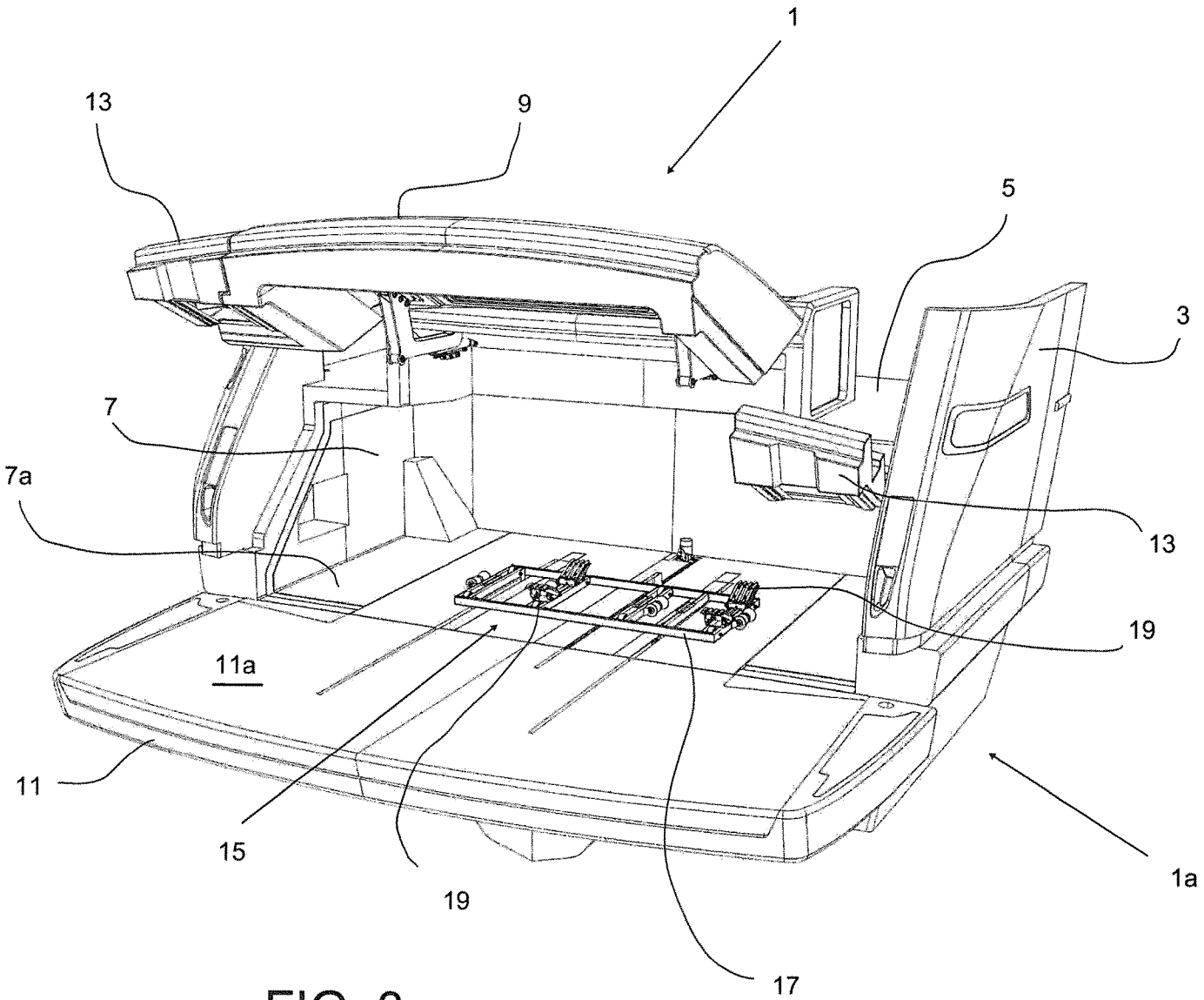
FIG. 3 schematically shows the boat portion of FIG. 2, with the platform in a first position, flush with the floor of the garage room, and the cradle for the water craft inside the garage room.
Figure 4:
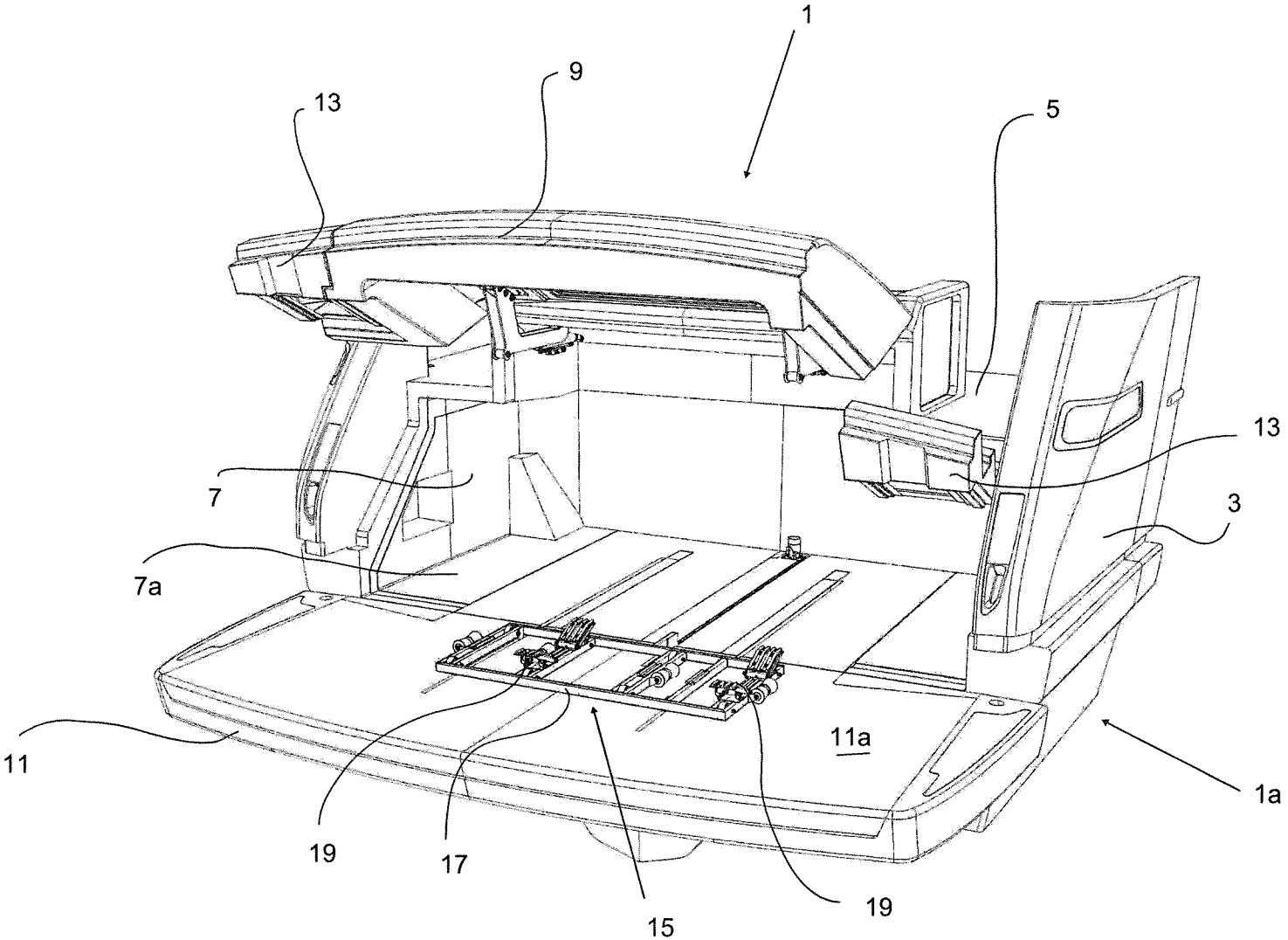
FIG. 4 schematically shows the boat portion of FIG. 3, with the cradle for the water craft on the platform.
Figure 5:
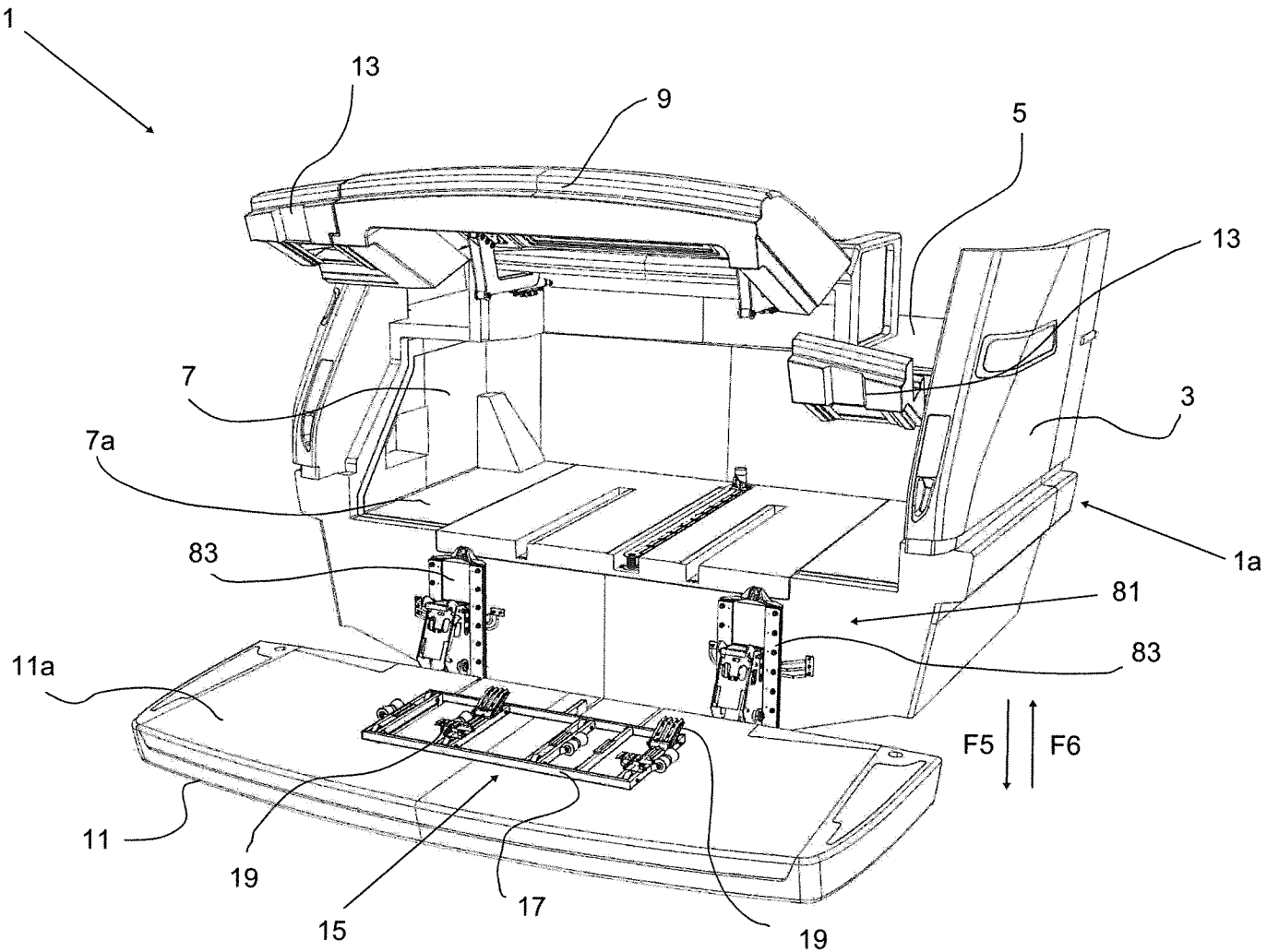
FIG. 5 schematically shows the boat portion of FIG. 4, with the platform in a second position, below the boat waterline.

Initially referring to FIGS. 1-5, a portion of a pleasure boat according to the invention, namely the stern portion of said pleasure boat, is schematically shown.

The pleasure boat 1 according to the invention may be, for instance, a yacht and it comprises a hull 3, on which a waterline is defined, and a deck 5.

At its stern portion 1*a*, the pleasure boat 1 comprises a parking area, accommodating at least one water craft (not shown).

Said water craft may be, for instance, a tender or a similar water craft suitable for short distances or a water craft for recreational and leisure purposes, such as a jet ski or the like, or in any case a water craft having such a size that it can be accommodated in the parking area arranged in the stern portion 1*a* of the boat 1.

In the illustrated embodiment, the parking area consists of a garage room 7 provided in the boat hull, at the stern portion 1*a*. In alternative embodiments of the invention, however, said parking area could be an open area arranged on the stern deck of the boat.

In order to keep the water craft sheltered when not in use, as well as for security reasons, the garage room 7 is preferably closed by a movable door 9, more particularly in the shown example by a pivoting door 9, which can move from a closed configuration (shown in FIG. 1) to an open configuration (shown in FIGS. 2-5). It is evident that other known solutions, such as a roller shutter, could also be used in substitution of the pivoting door 9.

The boat 1 according to the invention is provided with a system for launching/hauling said water craft, which system comprises a shelf or platform 11 arranged side by side with the hull 3 of the boat 1 at the garage room 7 and comprises a plane or floor 11*a* which is substantially parallel to the floor 7*a* of the garage room 7 and has a side adjacent to the outer side of the floor 7*a* of the garage room 7, said platform 11 being movable, preferably according to a pantograph movement, at least between a first position (shown in FIGS. 3 and 4), in which the floor 11*a* of the platform 11 is substantially flush with the floor 7*a* of the garage room 7, to a second position (shown in FIG. 5), in which the floor 11*a* of the platform 11 is below the waterline of the hull 3.

Moving means, which will be described in detail below, are provided for moving the platform 11 from the first to the second position.

It is to be noted that when the platform 11 is not being used for launching/hauling the water craft, it provides for an additional space that can be exploited by the boat passengers. Accordingly, stairs 13 are provided on one or both side(s) of the garage room for connecting the deck 5 to the platform 11.

Preferably, said stairs 13 are movable so that they can be moved in a non-hindering position when the water craft has to be launched or hauled. In the shown embodiment they are pivoting, like the door 9, and they could even be made integral to said door.

It is also to be noted that the platform 11 can also be moved in a third position (shown in FIGS. 1-2), further raised with respect to the first position, i.e. at a height from the waterline higher than that of the floor 7*a* of the garage room 7, so that said platform is completely above the waterline during navigation.

According to the invention, the system for launching/hauling the water craft of the boat 1 is designed so that it is possible to transfer the water craft from the garage room 7 to the platform 11, and vice versa, automatically and with no manual intervention by an operator.

To this purpose, said system comprises a cradle 15 intended to accommodate the water craft, said cradle comprising at least a frame 17 and holding means 19 for holding the water craft hull. Said holding means may advantageously be movable and/or orientable and/or replaceable, so that the same cradle can be used for water crafts having hulls with different shapes and sizes.

In the illustrated preferred embodiment, the cradle 15 is arranged in the garage room 7 so that the longitudinal axis (stern-bow axis) of the water craft is substantially perpendicular to the longitudinal axis (stern-bow axis) of the boat 1. Such arrangement advantageously allows to minimize the depth of the garage room 7 and use a platform 11 with a limited size.

Figure 6A:
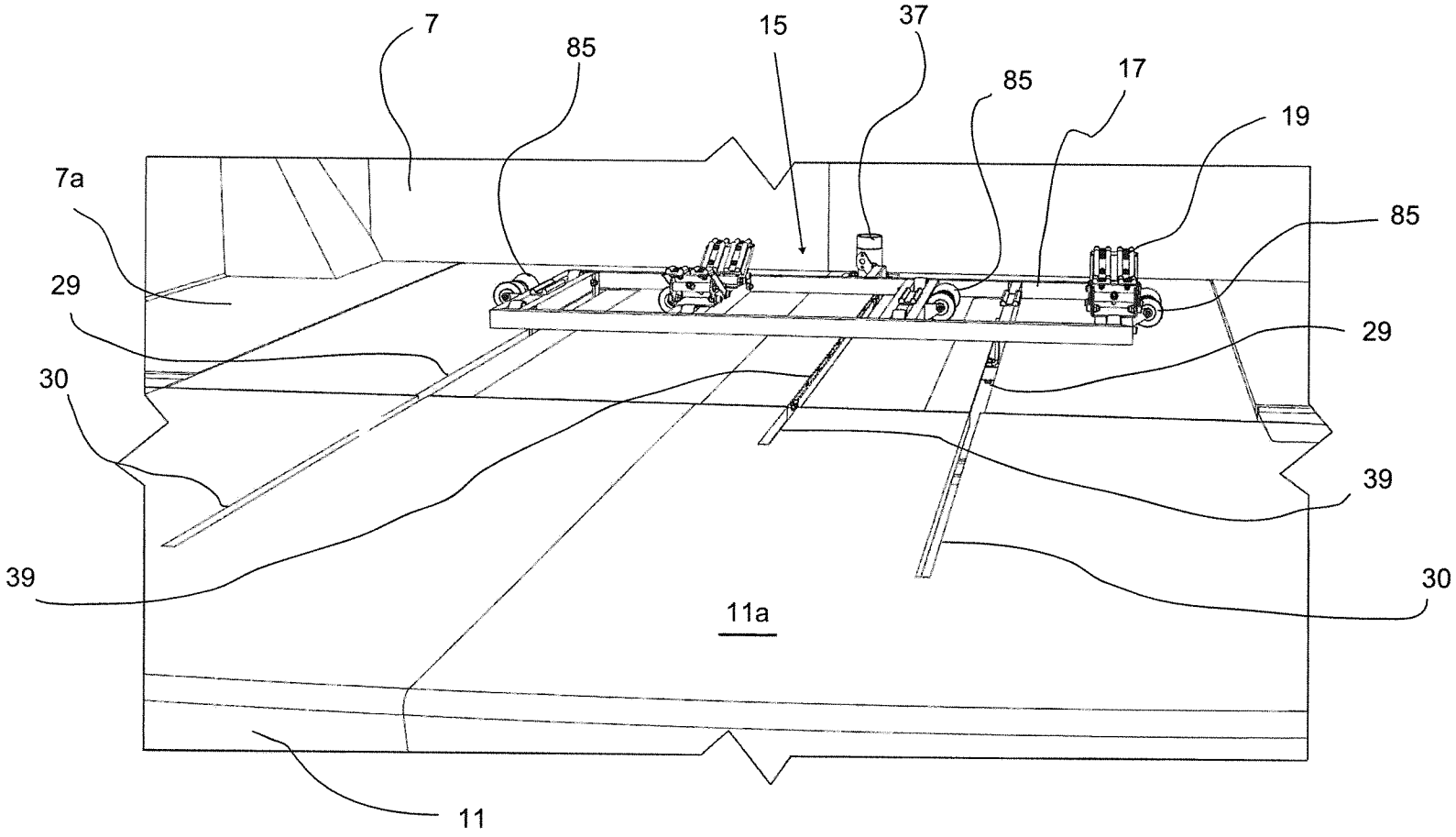
FIG. 6*a* shows a detail of FIGS. 1-5 relating to the garage room floor and to the platform floor.
Figure 6B:
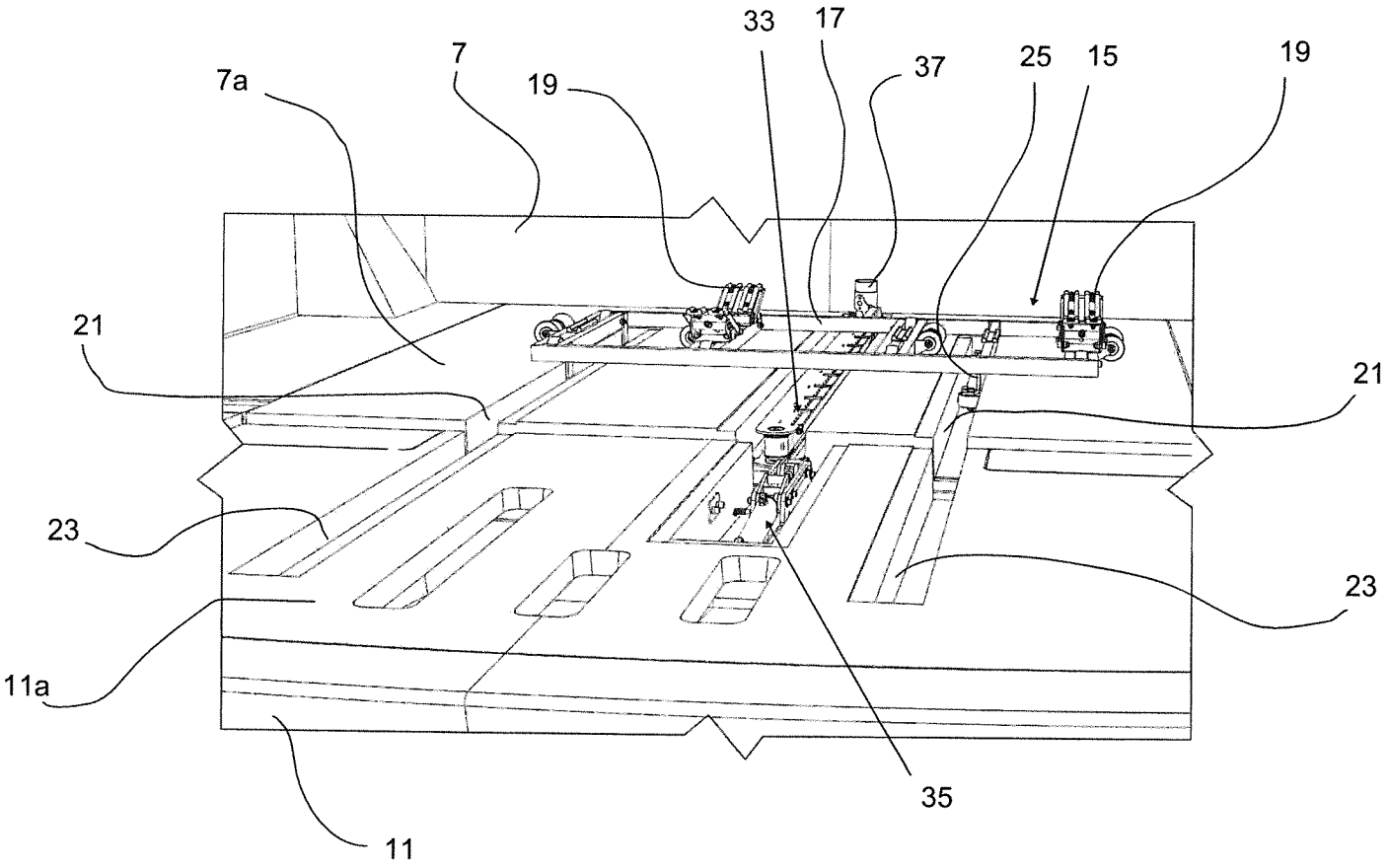
FIG. 6*b* is a version of FIG. 6*a* in which the garage room floor and the platform floor have been partially removed for showing the underlying components.

With reference also to FIGS. 6*a* and 6*b*, the system for launching/hauling the water craft further comprises a system for guiding the cradle 15 from the garage room 7 to the platform 11, and vice versa, said guiding system comprising first guides 21, extending along the floor 7*a* of the garage room 7 and ending at the side of said garage room facing the platform 11 and adjacent thereto, and second guides 23, extending along the floor 11*a* of the platform 11 and ending at the side of said platform facing the garage room 7 and adjacent thereto, the end portion of each first guide facing the end portion of a corresponding second guide and being aligned thereto.

In the shown embodiment, two first guides 21 and, correspondingly, two second guides 23 are provided, but it is evident that a different number of first and second guides could also be provided.

The two first guides 21, as well as the two second guides 23, are parallel to each other. In the shown embodiment, the first and second guides 21, 23 are rectilinear and arranged in a direction substantially perpendicular to the longitudinal axis of the cradle 15. However, said first and second guides could also have a different path, provided that the end portion of each first guide faces the end portion of a corresponding second guide and is aligned thereto.

Preferably, the first and second guides 21, 23 are recessed in the floor 7*a* of the garage room 7 and in the floor 11*a* of the platform 11, respectively, so that they do not form an obstacle and the risk that someone stumbles thereon is avoided. More particularly, said first and second guides 21, 23 can be made as channels having a "U"-shaped cross-section below the floor 7*a* of the garage room 7 and the floor 11*a* of the platform 11, respectively. For being driven along the first and second guides 21, 23, the cradle 15 is provided with retaining elements 25 connected to the frame 17 and suitable for binding the cradle to said first and second guides 21, 23, while allowing the movement of said cradle along said guides.

Figure 7:
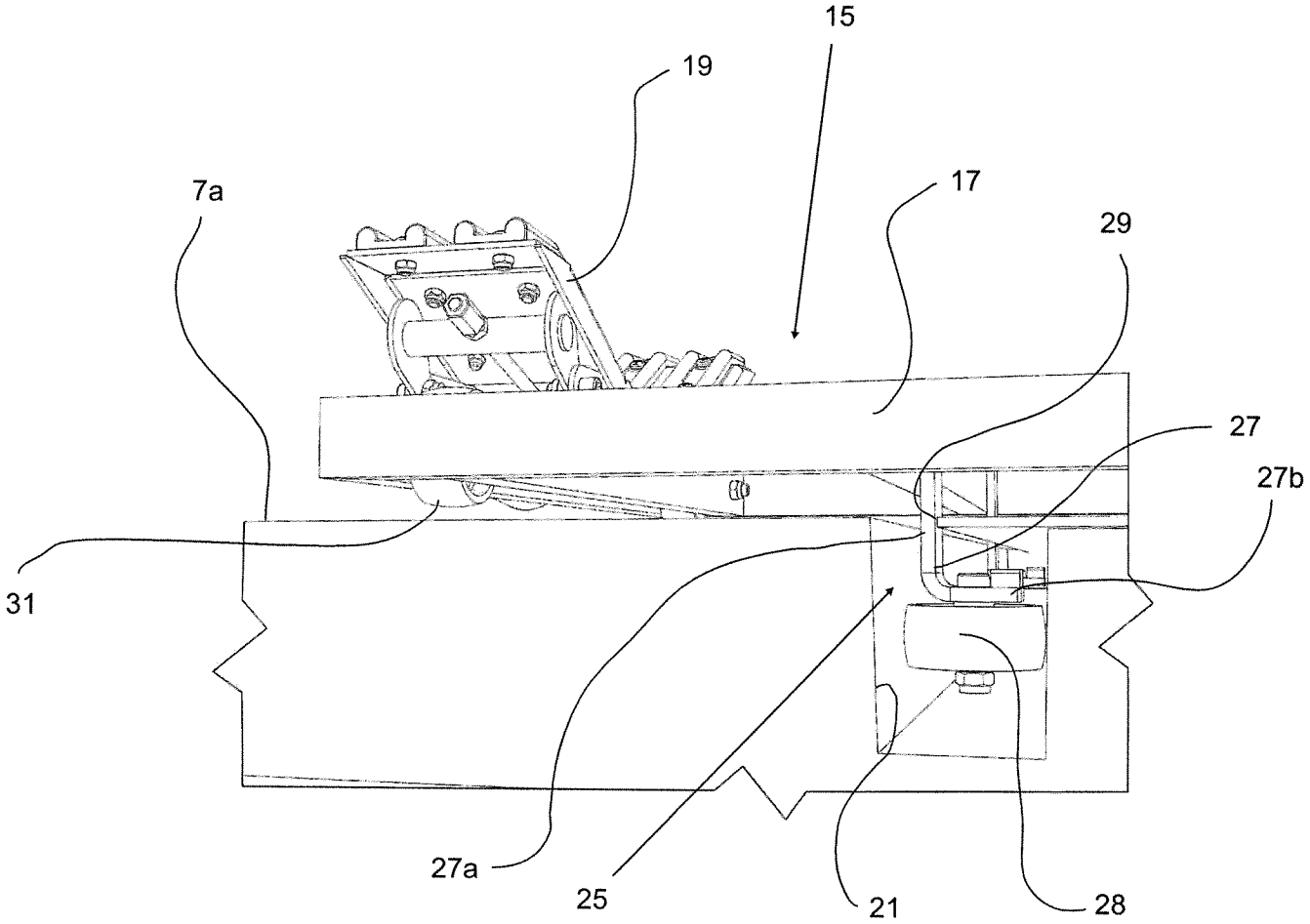
FIG. 7 is an enlarged view of a detail of FIG. 6*a* relating to the bounding arrangement of the cradle to the guides.

Said retaining elements 25 are shown in detail in FIG. 7. They comprise an L-shaped arm 27 including a vertical section 27*a*, which at its free end is fixed to the frame 17 of the cradle 15 and penetrates into a first guide 21 (or into a second guide 23) and a horizontal section 27*b*, to which a wheel 28 is fastened, said wheel having a rotation axis perpendicular to the floor 7*a* of the garage room 7 (or to the floor 11*a* of the platform 11) and a diameter equal to the width of said guides, so that it is able to roll along the lateral walls of the guide in the form of a "U"-shaped channel.

As can be seen in FIG. 7, advantageously the first guides 21 do not directly open on the floor 7*a* of the garage room 7 but they are completely arranged therebelow and said floor 7*a* has narrow slits 29, the width of which is sufficiently large to allow the passage of the vertical section 27*a* of the arms 27, yet small enough to prevent the horizontal section 27*b* of the arms 27 and the wheels 28 from slipping out from the guides.

The floor 11*a* of the platform 11 and the second guides 23 are designed in a similar manner and the floor 11*a* of the platform 11 also has narrow slits 30.

Such arrangement involves several advantages: firstly, jamming of the cradle during is translational movement along the guides 21, 23 is avoided, even if it is pushed offset to its center of gravity; secondly, the correct exit direction is ensured; thirdly, any movement of the cradle 15 relative to the guides 21, 23 in the vertical direction is prevented, so that the accidental disengagement of said cradle from said guides is correspondingly prevented; finally, the guides 21, 23 and the retaining elements 25 are substantially hidden and only the slits 29, 30 are visible, which reduces the impact of the guiding system on the appearance of the boat.

In FIG. 7 it can also be seen that the frame 17 of the cradle 15 is provided with further wheels 31 having a rotation axis parallel to the longitudinal axis of the cradle: thanks to these further wheels friction can be reduced when the cradle is moved from the garage room 7 to the platform 11 and vice versa.

The system for launching/hauling the water craft further comprises a handling system—shown in FIG. 6*b*—for moving said cradle along the above described guiding system, from said garage room to said platform and vice versa.

According to the invention, said handling system comprises a first handling assembly 33, located in the garage room 7 and arranged for moving the cradle 15 along the first guides 21, and a second handling assembly 35, located in the platform 11 and arranged for moving the cradle 15 along the second guides 23, said second handling assembly 35 being separate and independent from the first handling assembly 33.

Advantageously (as described more in detail below) said first handling assembly 33 is provided with connecting means for connection to the cradle 15 which are shaped so as to release said cradle at the end portion of the first guides 21 when the cradle is transferred from the garage room to the platform, and to engage with said cradle at the end portion of the first guides 21 when the cradle is transferred from the platform to the garage room. Analogously, said second handling assembly 35 is provided with connecting means for connection to the cradle 15 which are shaped so as to release said cradle at the end portion of the second guides 23 when the cradle is transferred from the platform to the garage room, and to engage with said cradle at the end portion of the second guides 23 when the cradle is transferred from the garage room to the platform.

A motor 37 drives said first and second handling assemblies 33, 35. The motor 37 preferably is a hydraulic motor, but also other types of motors adequate for this purpose and known to the people skilled in the art can be used.

In the shown embodiment, the first and second handling assemblies 33, 35 are arranged in a central position, at the same distance from either first guides 21 and second guides 23, respectively. However, a different arrangement of said handling assemblies relative to the guides of the guiding system could also be possible.

In the shown embodiment, the first and second handling assemblies 33, 35 are advantageously arranged below the floor 7*a* of the garage room 7 and the floor 11*a* of the platform 1, respectively, and slots 39, 41 are provided in the floor 7*a* of the garage room 7 and in the floor 11*a* of the platform 11 for allowing to connect the cradle 15 to said first and second handling assemblies.

As already set forth above with reference to the guides of the guiding system, such arrangement is particularly advantageous both for the correct moving of the cradle and for the passengers' safety as well as for the quality of the appearance of the boat. The handling system of the system for launching/hauling a water craft of the boat 1 is illustrated in greater detail in FIGS. 8-10, showing the sequence for transferring the cradle 15 from the garage room 7 to the platform 11.

Figure 8:
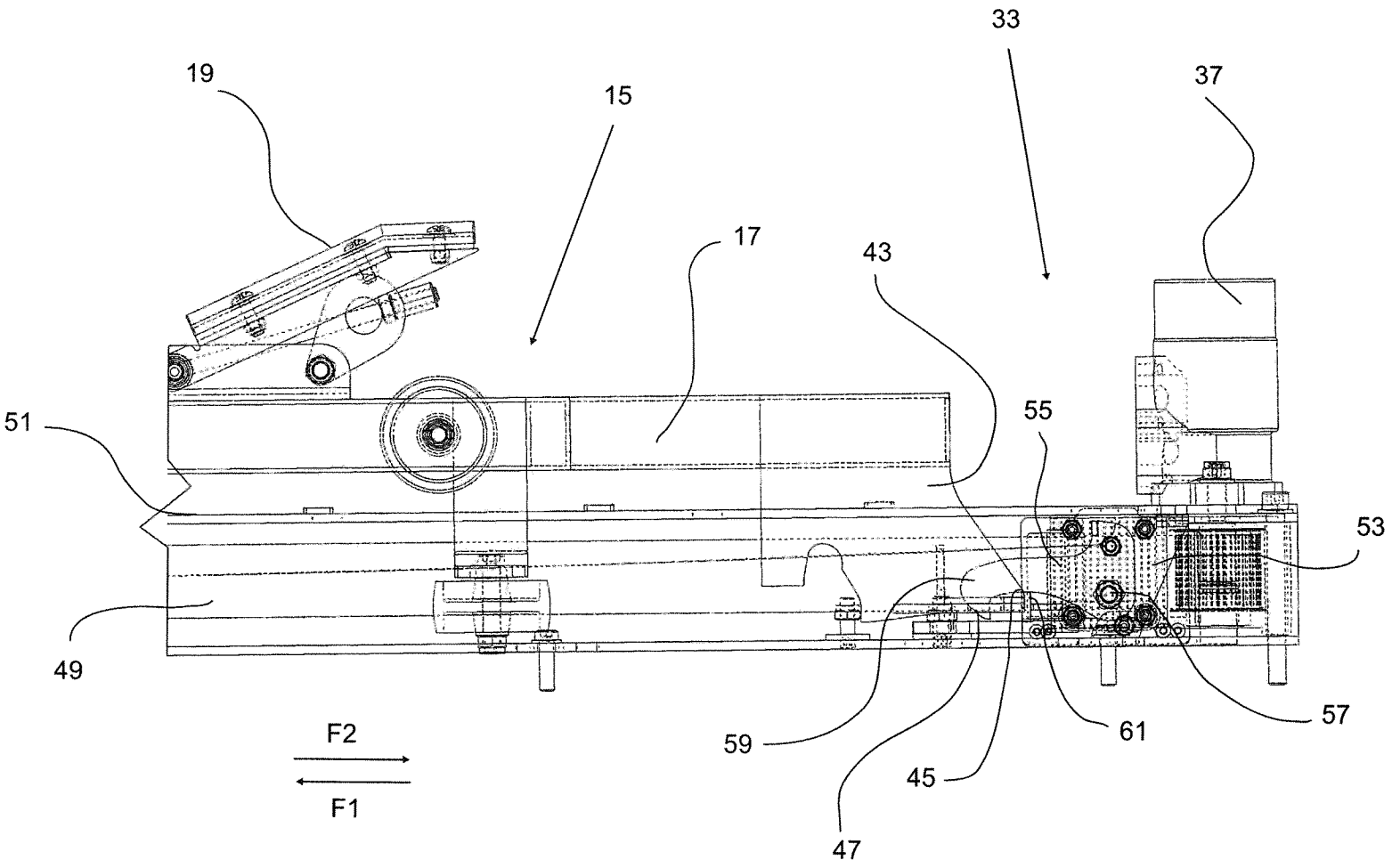
FIGS. 8-10 schematically show the system for moving the cradle, shown in different positions.

Initially referring to FIG. 8, the cradle 15 comprises a bracket 43, mounted on the frame 17 of said cradle and extending downwards, thus penetrating into the slit of the floor 7*a* of the garage room 7. The bracket 43 is so shaped that it has, at its side away from the platform 11, an abutment surface 45 and a through-hole 47.

The first handling assembly 33 comprises a belt 49 which is mounted on a guide 51, arranged below the floor 7*a* of the garage room 7 and parallel to the first guides 21, and which is driven by the motor 37. A plate 53 is fastened to the belt 49, on which plate the connecting element 55 for connection to the cradle 15 is mounted. The connecting element 55 is mounted on the plate 53 so as to rotate about a pin 57. Said connecting element has a hook 59 which fits into the through-hole 47 of the bracket 43, thus achieving the connection between the first handling assembly 33 and the cradle 15. The plate 53 has a thrust surface 61 facing the abutment surface 45 of the bracket 43. When the motor 37 is driven for moving the belt towards the platform 11 (arrow F1), the thrust surface 61 moves forwards and applies a pressure against the abutment surface 45, thus pushing the cradle 15 along the first guides 21, towards the platform 11.

Figure 9:
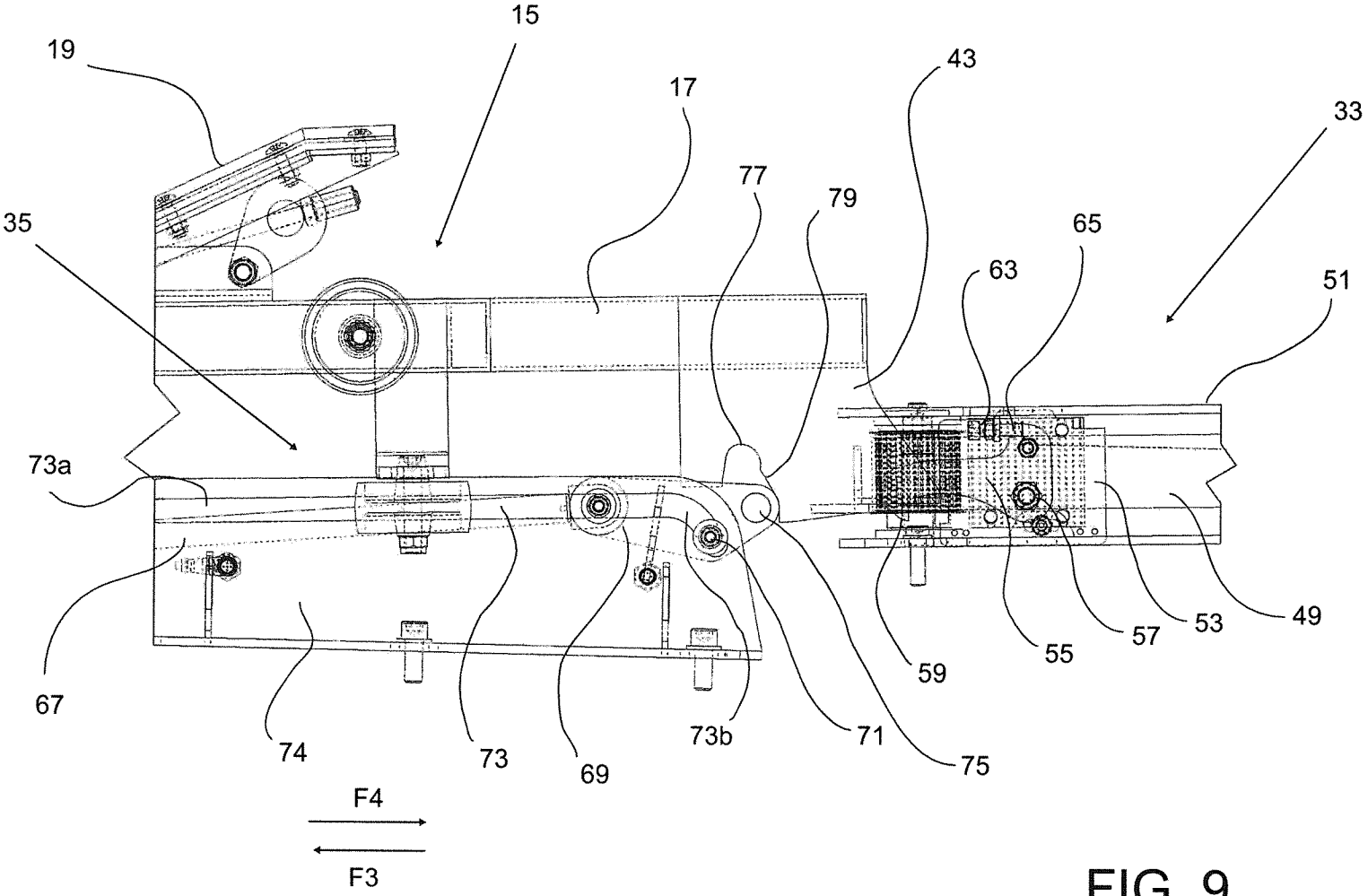
Figure 10:
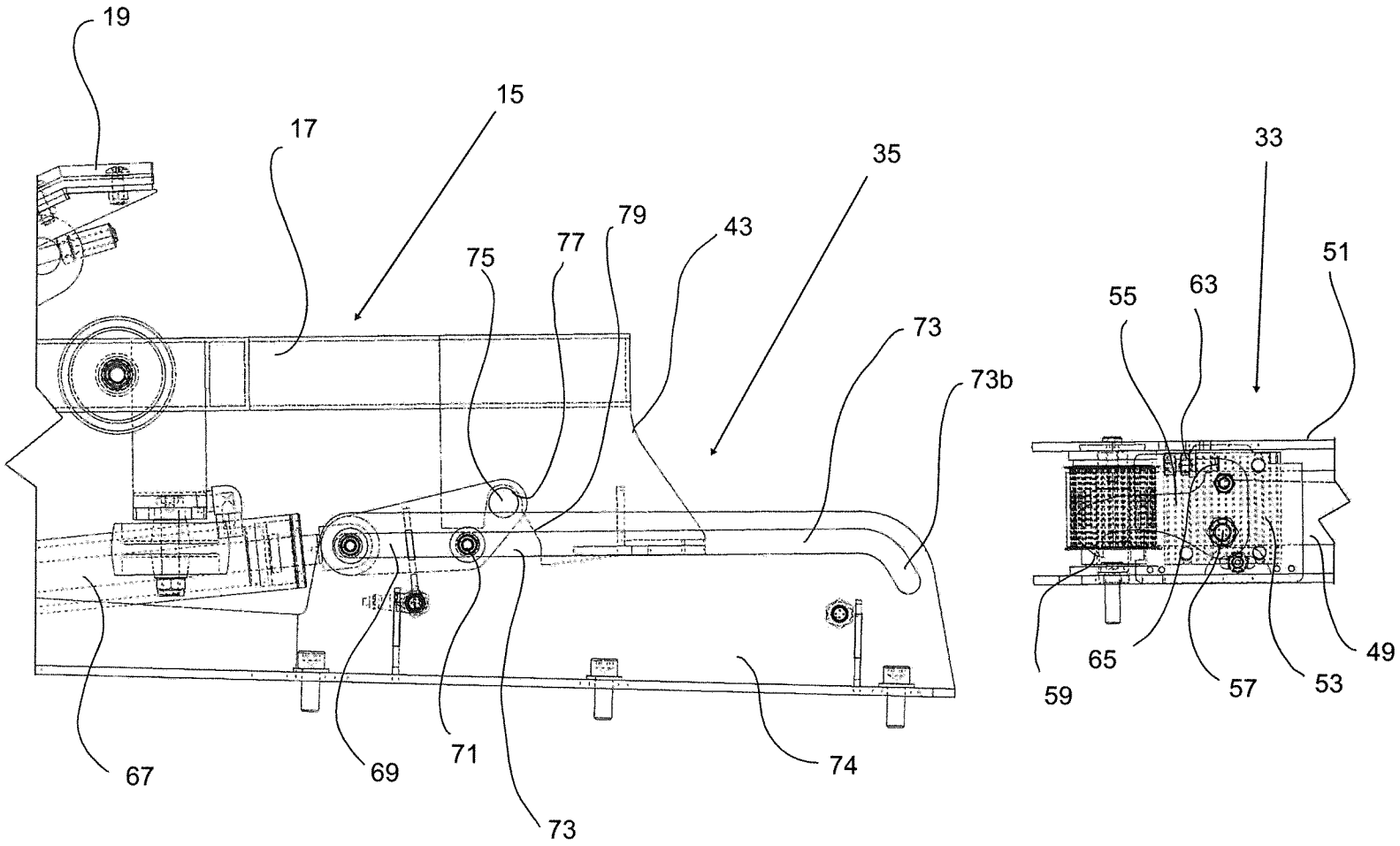

With reference now to FIG. 9, the situation is shown in which the cradle 15, advancing towards the platform 11, has reached the end portion of the first guides 21, i.e. the side of the floor 7*a* of the garage room 7 facing the platform 11. In this position, a stop element 63 is mounted on the guide 51 of the belt 49, which stop element is arranged so as to abut against a counter-surface 65 provided in the connecting element 55, on the opposite side of the pin 57 with respect to the hook 59. When the belt 49—driven by the motor 37—arrives at this position, the stop element 63 abuts against the counter-surface 65, thus causing the connecting element 55 to rotate about the pin 57 and the hook 59 to come out of the through-hole 47 of the bracket 43. In this way, the cradle 15 is released from the first handling assembly 33.

In FIG. 9 the second handling assembly 35 is also shown. Said second handling assembly comprises a cylinder 67—preferably, a hydraulic cylinder—the rod of which can move from a fully extended position to a fully retracted position, and vice versa. A pair of parallel plates 69 are articulated at the end of the rod of the cylinder 67, which plates are connected to each other by a peg 71 which extends beyond said plates and engages into a rail 73 provided in a support 74, mounted below the floor 11*a* of the platform 11 and parallel to the second guides 23. The rail 73 comprises a straight portion 73*a* and, at the end portion of the second guides 23 (i.e. at the side of the platform 11 facing the garage room 7), a downwardly curved portion 73*b*. In FIG. 9 the situation is shown in which the rod of the cylinder 67 of the second handling assembly 35 is fully extended and the peg 71 is at the end of the downwardly curved portion 73*b* of the rail 73.

The connecting element of the second handling assembly 35 for connection to the cradle 15 is a web 75 arranged between the plates 69. Accordingly, the bracket 43 of the cradle 15, on the side facing the platform 11, comprises at its lower edge a seat 77, preferably joined to a pilot surface 79.

When the cradle is at the end portion of the first guides 21 and it has been released from the first handling assembly, the cylinder 67 is driven for moving its rod from the extended position to the retracted position (arrow F3). In this way, the peg 71 moves upwards along the downwardly curved portion 73*b* of the rail 73, thus causing an upward movement of the plates 69 and of the web 75 connected thereto. During such upward movement, said web moves upwards along the pilot surface 79 and fits into the seat 77 of the bracket 43: the engagement of the second handling assembly 35 with the cradle 15 is therefore achieved.

In FIG. 10 a situation is shown in which the cylinder 67—already engaged with the bracket 43 thanks to the web 75—has drawn the cradle 15 onto the platform 11. The rod of the cylinder 67 is in the retracted portion and the peg 71 has moved along the entire rail 73, up to the end of the straight portion 73*a*.

For completing the water craft launching, the handling system also comprises a third handling assembly 81 (visible in FIG. 5) for moving the platform 11 (arrow F5) from the first position (with its floor 11*a* flush with the floor 7*a* of the garage room 7) to the second position (with its floor 11*a* below the waterline of the hull 3). Said third handling assembly 81 can have a very simple structure, since it has to cause the platform 11 to make a simple pantograph movement, and it may comprise, for instance, a pair of cylinders 83, preferably hydraulic cylinders.

From the above description, it will be evident to the person skilled in the art how the system according to the invention works for hauling the water craft:

- the water craft is placed onto the cradle 15 while the platform 11 is in said second position;
- the third handling assembly 81 is driven for moving said platform 11 from the second position to the first position (arrow F6 in FIG. 5);
- the second handling assembly 35 is driven for moving the rod of the cylinder 67 from the fully retracted position to the fully extended position (arrow F4 in FIG. 9);
- at the side of the platform 11 facing the garage room 7, the peg 71 is guided to the downwardly curved portion 73*b* of the rail 73 and draws downwards the plates 69 and the web 75, which comes out of the seat 77 of the bracket 43, thus releasing the cradle 15 from the second handling assembly 35;
- in this position, with the cradle released from the second handling assembly, the belt 49 is driven for moving away from the platform 11 (arrow F2 in FIG. 8), thus disengaging the counter-surface 65 from the stop element 63 and causing the connecting element 55 to rotate about the pin 57; in this way the hook 59 penetrates into the through-hole 47 of the bracket 43, thus engaging again the cradle 15 with the first handling assembly;
- by continuing the movement of the belt 49 away from the platform 11, the hook 59 draws the bracket 43, thus causing the cradle 15 to move along the first guides 21, up to the starting position.

From the above description, it is evident that the invention achieves the main object set forth above, since no intervention by an operator is needed for launching/hauling the water craft and driving of the first, second and third handling assemblies 33, 35 81 can take place in a completely automatic way and can be remotely controlled.

With reference for instance to FIGS. 6*a* and 6*b*, it is to be noted that in the described and illustrated preferred embodiment the frame 17 of the cradle 15 is provided with a plurality of rollers 85 arranged with their rotation axes substantially perpendicular to the longitudinal axis of the cradle 15.

Said rollers 85 allow to adjust—with a minimum effort—the position of the water craft relative to the cradle 15. This arrangement turns out to be very useful, as it allows to correctly position the water craft and reduces the risk of jamming of the system for launching 7 hauling the water craft, and it further avoids the risk of collisions of the water craft against the walls of the garage room 7.

It will be evident to the person skilled in the art that the invention is not limited to the above-disclosed embodiments, but several variants and modifications are possible within the scope of the appended claims.

The invention claimed is:

1. A pleasure boat, comprising a hull on which a waterline is defined and which includes a parking area, accommodating at least one water craft, wherein the pleasure boat further comprises a system for launching and hauling the water craft, wherein the system for launching and hauling the water craft includes a platform, which is located side by side relative to the hull at the parking area and comprises a floor that is substantially parallel to the floor of the parking area and has a side which is adjacent to the side of the floor of the parking area that is facing towards the outside of the hull, wherein the platform is movable at least between a first position in which the floor of the platform is substantially flush with the floor of the parking area and a second position in which the floor of the platform is below the waterline of the hull, wherein the system for launching and hauling the water craft further comprises:

- a cradle for receiving the water craft, the cradle comprising at least a frame and holding means for holding the hull of the watercraft;
- a guiding system for guiding the cradle from the parking area to the platform and vice versa, wherein the guiding system comprises one or more first guides extending along the floor of the parking area and ending with an end portion at the side of the floor of the parking area facing the side of the floor of the platform and adjacent to the side of the floor of the platform, and one or more second guides extending along the floor of the platform and ending with an end portion at the side of the floor of the platform facing the side of the floor of the parking area and adjacent to the side of the floor or the parking area, wherein the end portion of each of the first guides face the end portion of a respective second guide and is aligned with the end portion of the respective second guide;
- a handling system for moving cradle from the parking area to the platform and vice versa, wherein the handling system comprises at least a first handling assembly provided in the parking area and arranged to move the cradle along the first guides and a second handling assembly, separate and independent from the first handling assembly, provided in the platform and arranged to move the cradle along the second guides.

2. The pleasure boat according to claim 1, wherein the first handling assembly includes a connecting element for the connection to the cradle and wherein the connecting element is arranged to release the cradle at the end portion of the first guides when the cradle is moved from the parking area to the platform, and for engaging with the cradle at the end portion of the first guides when the cradle is moved from the platform to the parking area.

3. The pleasure boat according to claim 1, wherein the second handling assembly includes a connecting element for the connection to the cradle and wherein the connecting element is arranged to release the cradle at the end portion of the second guides when the cradle is moved from the platform to the parking area and for engaging with the cradle at the end portion of the second guides when the cradle is moved from the parking area to the platform.

4. The pleasure boat according to claim 1, wherein the handling system further comprises a third handling assembly for moving the platform from the first position to the second position and vice versa.

5. The pleasure boat according to claim 1, wherein two first guides are provided and the first handling assembly is arranged between the two first guides, substantially equidistant from the first guides, and wherein two second guides are provided and the second handling assembly is arranged between the two second guides, substantially equidistant from the second guides.

6. The pleasure boat according to claim 1, wherein the first guides and the second guides are provided below the plane on which the floor of the parking area lies and below the plane on which the floor of on which the platform lies, respectively.

7. The pleasure boat according to claim 6, wherein the first guides and the second guides are made as channels having a U-shaped cross-section.

8. The pleasure boat according to claim 7, wherein the cradle is provided with retaining elements for linking the cradle to the first guides and to the second guides, wherein the retaining elements comprise an L-shaped arm having a vertical portion that is fastened at its free end to the cradle and penetrates into one of the first guides and second guides, and a horizontal portion carrying a wheel, the rotation axis of which is substantially perpendicular to the plane one which the floor of the parking area lies and to the plane one which the floor of the platform and the diameter of which is equal to the width of the U-shaped channel.

9. The pleasure boat according to claim 8, wherein the floor of the parking area and the floor of platform are provided with slits, the thickness of which is sufficiently large for allowing the passage of the vertical portion of the arms but small enough to prevent the horizontal portion of the arms and the wheels from slipping out of the first and second guides.

10. The pleasure boat according to claim 1, wherein the first handling assembly is arranged below the plane one which the floor of the parking area lies and wherein the floor of the parking area being is provided with slots for allowing the connection of the cradle to the first handling assembly.

11. The pleasure boat according to claim 10, wherein the cradle is provided with a bracket which extends downwards and which is arranged to penetrate into the slots of the floor of the parking area for connecting the bracket to the first handling assembly.

12. The pleasure boat according to claim 11, wherein the first handling assembly comprises a belt mounted on a guide that is arranged parallel to the first guides, a plate attached to the belt, a connecting element for the connection to the cradle, which connecting element is pivotally mounted on the plate about a pin, wherein the connecting element has a hook arranged to be engaged in a through-hole provided in the bracket, wherein the plate has a thrust surface arranged to abut against an abutment surface provided in the bracket, and wherein the connecting element is arranged to pivot about the pin so as to make the hook come out of the through-hole of the bracket when the plate is at the side of the floor of the parking area facing the side of the floor of the platform.

13. The pleasure boat according to claim 1, wherein the frame of the cradle is provided with a plurality of rollers which are arranged with their rotation axes substantially perpendicular to the longitudinal axis of the cradle.

14. The pleasure boat according to claim 1, wherein the boat has a bow portion and a stern portion, wherein the parking area is provided at the stern portion of the boat and wherein the cradle is arranged in the parking area so that the longitudinal axis of the water craft is substantially perpendicular to the longitudinal axis of the boat.

15. The pleasure boat according to claim 10, wherein the second handling assembly is arranged below the plane on which the floor of the platform lies and wherein the floor of the platform is provided with slots for allowing the connection of the cradle to the second handling assembly.

16. The pleasure boat according to claim 15, wherein the cradle is provided with a bracket which extends downwards and which is arranged to penetrate into the slots of the floor of the parking area and into the slots of the floor of the platform for connecting the bracket to the first handling assembly and to the second handling assembly, respectively.

17. The pleasure boat according to claim 16, wherein the second handling assembly comprises a cylinder, the rod of which can move from a fully extended position to a fully retracted position and vice versa, a pair of parallel plates hinged at the end of the rod of the cylinder, a peg connecting the plates and protruding beyond the plates for engaging in a rail provided in a support that is arranged parallel to the second guides, a connecting element for the connection to the cradle, wherein the connecting element is a web arranged between the plates and arranged to be engaged in a seat provided at the bottom edge of the bracket, wherein at the side of the floor of the platform facing the side of the floor of the parking area the rail has a downwardly curved portion, so that the web slips out of the seat of the bracket when the peg is guided along the downwardly curved portion of the rail.

18. The pleasure boat according to claim 2, wherein the second handling assembly includes a connecting element for the connection to the cradle and wherein the connecting element is arranged to release the cradle at the end portion of the second guides when the cradle is moved from the platform to the parking area and for engaging with the cradle at the end portion of the second guides when the cradle is moved from the parking area to the platform.

* * * * *